US008887488B1

(12) United States Patent
Paulino

(10) Patent No.: US 8,887,488 B1
(45) Date of Patent: Nov. 18, 2014

(54) POWER PLANT FOR UAV

(75) Inventor: Jose R. Paulino, West Palm Beach, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 890 days.

(21) Appl. No.: 13/084,800

(22) Filed: Apr. 12, 2011

(51) Int. Cl.
*F02C 9/18* (2006.01)
*F02K 3/12* (2006.01)

(52) U.S. Cl.
USPC ..... 60/263; 60/224; 60/269; 60/39.15

(58) Field of Classification Search
CPC ..... B64C 2201/048; B64C 2201/16; B64C 2201/162; B64C 2700/62956; F02C 6/02; F02C 6/04; F02C 3/13; F02C 6/06; F02C 6/08; F02C 9/18; F02K 3/08; F02K 3/12; F02K 3/115; F02K 3/11; F02K 3/105
USPC ..... 60/224, 225, 244, 245, 226.1, 39.15, 60/791, 39.17, 39.163
See application file for complete search history.

(56) References Cited

U.S. PATENT DOCUMENTS 2,518,498 A * 8/1950 Schulte ..... 60/224
2,526,941 A * 10/1950 Fishbein ..... 60/39.15
2,677,932 A * 5/1954 Forsling ..... 60/39.15
3,368,352 A * 2/1968 Hewson ..... 60/224
3,442,082 A * 5/1969 Peterson ..... 60/224
3,585,795 A * 6/1971 Grieb ..... 60/39.163
3,635,019 A * 1/1972 Kronogard et al. ..... 60/39.15
3,765,170 A * 10/1973 Nakamura ..... 60/39.17
4,147,024 A * 4/1979 Moellmann ..... 60/39.15
4,858,428 A * 8/1989 Paul ..... 60/39.17
5,433,069 A * 7/1995 Houghton et al. ..... 60/39.15
7,107,756 B2 * 9/2006 Rolt ..... 60/224
2002/0189230 A1 * 12/2002 Franchet et al. ..... 60/224
2002/0190159 A1 * 12/2002 Franchet et al. ..... 244/74
2007/0137203 A1 * 6/2007 Yanai et al. ..... 60/644.1
2010/0154435 A1 * 6/2010 Exley et al. ..... 60/792

* cited by examiner

*Primary Examiner* — Ted Kim
(74) *Attorney, Agent, or Firm* — John Ryznic

(57) ABSTRACT

A high efficiency power plant for a UAV with a high pressure ratio gas turbine engine used for low power operation such as loiter speed and a low pressure ratio gas turbine engine used for high power operation. A power turbine receives hot gas flows from the two engines to drive an output shaft. At low power operation, only the high pressure ratio engine is operated. At high power operation, both engines are operated where the exhaust from the high pressure ratio engine is used to drive a turbine of the low pressure ratio engine. A compressor of the low pressure ratio engine supplies compressed air to a combustor that produces a hot gas stream that is passed through the power turbine.

6 Claims, 3 Drawing Sheets

POWER PLANT FOR UAV

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a high efficiency engine used to power an unmanned aero vehicle or UAV.

2. Description of the Related Art Including Information Disclosed Under 37 CFR 1.97 and 1.98

An unmanned aero vehicle (UAV) is currently being used for reconnaissance such as for military use. The US Army is a large user of these UAVs because they are small, do not use a lot of fuel, and do not require a pilot on board the aircraft. The main objective of an engine for a UAV is high fuel efficiency at low speeds, or while loitering, to allow the UAV to spend more time patrolling its target.

One prior art engine for a UAV is a diesel engine that drives a propeller. The diesel engine is a relatively high efficiency engine so the fuel consumption is very low. However, the diesel engine is a relatively heavy engine which must be carried by the aircraft, and thus less fuel can be carried. Small gas turbine engines have been considered for use in a UAV but are not as efficient when compared to a diesel engine unless a recuperator is used. Adding a recuperator to a small gas turbine engine on a UAV creates a rather large engine. A rotary engine has also been used to power a UAV but is unreliable because these engines do not last very long. In some cases, the aircraft does not even make it back to the base and thus the entire aircraft is lost.

To be effective for use on a UAV, the engine must be able to fly at three speeds. The engine must have the capability of high enough power for takeoff. The engine must also have the power for what is referred to as dash speed when the aircraft is airborne and must fly to the destination rather quickly. Then, the most important operational speed for the engine is loiter or low speed which is when the aircraft must fly for long periods of time at the most fuel efficient rate. One major disadvantage of the gas turbine engine is that the engine is designed to operate at one speed with a high efficiency. At lower operational speeds, the gas turbine engine is at a relatively low efficiency. Without using variable vanes, the gas turbine engine by itself is not a very attractive engine for a UAV.

BRIEF SUMMARY OF THE INVENTION

The high efficiency engine configuration for powering a UAV includes a first gas turbine engine with a high pressure ratio and a second gas turbine engine with a low pressure ratio. The high pressure ratio engine discharges turbine exhaust into the turbine of the low pressure ratio engine to drive the compressor which then provides compressed air to a second combustor to produce a hot gas stream that is passed through a power turbine that drives the output shaft of the engine. At a loiter speed, only the first gas turbine engine is operated and the turbine exhaust is passed through the power turbine to drive the output shaft. The high pressure ratio engine is the higher efficiency engine of the power plant and as such operates continuously.

At the maximum power output, both engines are operated in which the turbine exhaust of the first engine is used to drive the second turbine in the low pressure ratio engine which then drives the second compressor to produce compressed air for a second combustor that produces a hot gas stream that is passed through the power turbine to drive the output shaft. The low pressure ratio engine is used only when high power is required such as take off and dash speed.

DETAILED DESCRIPTION OF THE INVENTION

The high efficiency engine of the present invention is intended to be used for a power plant of an unmanned aero vehicle (UAV). However, the high efficiency engine can be used for other power plants that require a high efficiency engine that is capable of higher power for short durations of time.

Figure 1:
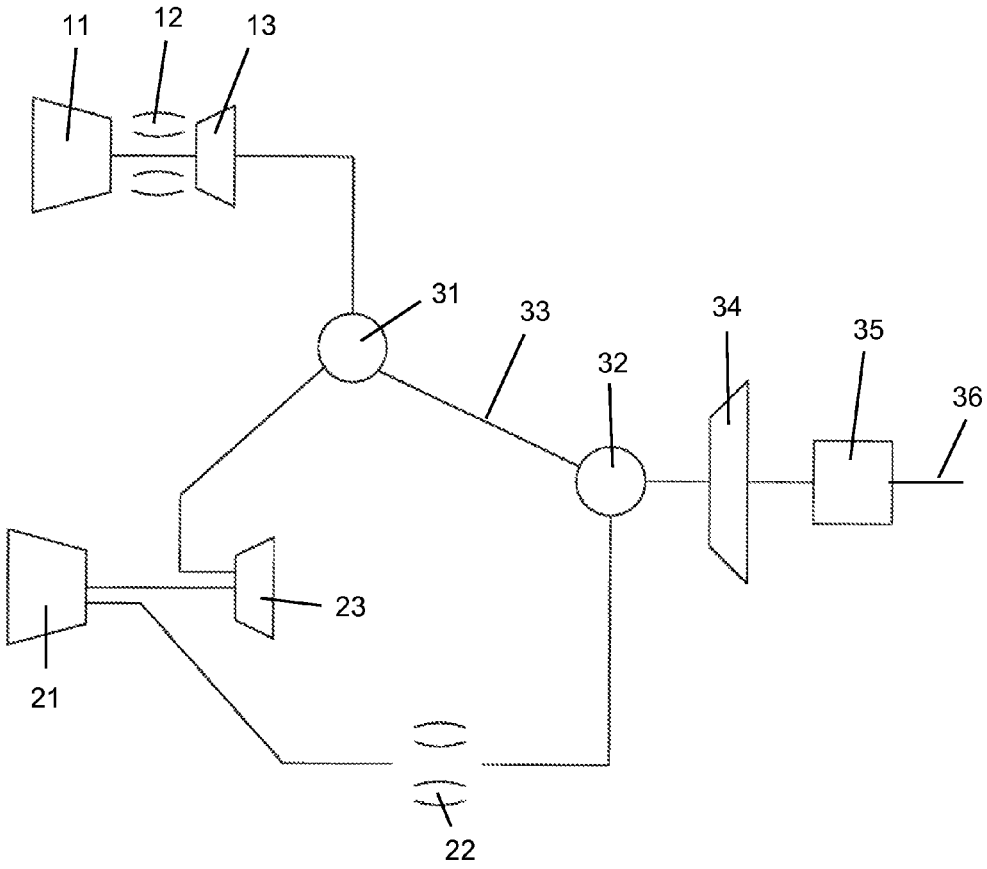
FIG. 1 shows a cross section view of the high efficiency power plant of the present invention with two gas turbine engines.

FIG. 1 shows the components of the high efficiency power plant and includes a high pressure ratio gas turbine engine with a first compressor 11, a first combustor 12 and a first turbine 13 in which the first turbine 13 drives the first compressor 11 through a common rotor shaft. The first turbine 13 exhaust is connected to a first flow valve 31 through a hot gas tube or conduit.

The high efficiency power plant includes a low pressure ratio gas turbine engine with a second compressor 21, a second combustor 22 and a second turbine 23. The second turbine 23 is connected to the second compressor 21 through a common rotor shaft. The second combustor 22 is not connected between the compressor output and the turbine inlet like in a typical gas turbine engine. The first flow valve 31 is also connected to the second turbine 23 through a hot gas conduit.

The second combustor 22 is connected to a second flow valve 32 through a hot gas conduit. The first flow valve 31 is also connected to the second flow valve 32 through the hot gas conduit 33. The second flow valve 32 is connected to a power turbine 34 that is used to power the aircraft. A gear box 35 can be used to lower the rotational speed from the power turbine in order to drive a propeller shaft or an unducted fan shaft 36.

Figure 2:
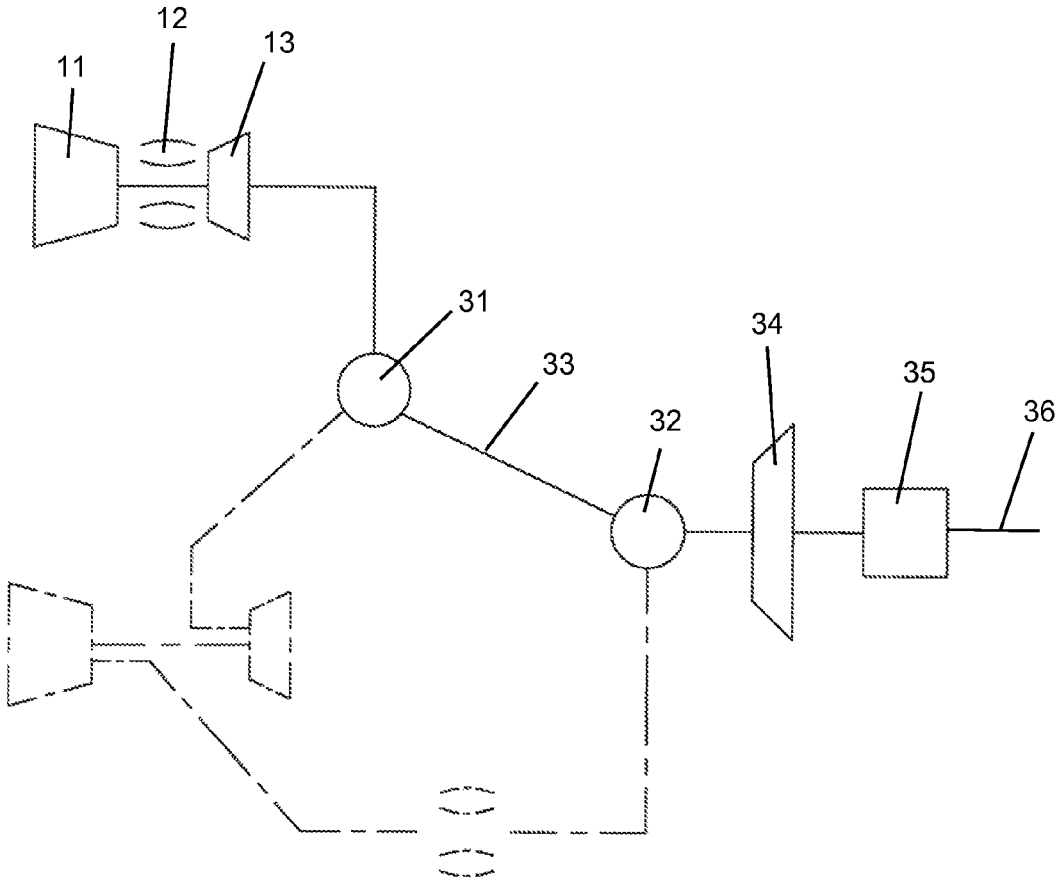
FIG. 2 shows the high efficiency power plant of the present invention in a loiter speed operational mode.
Figure 3:
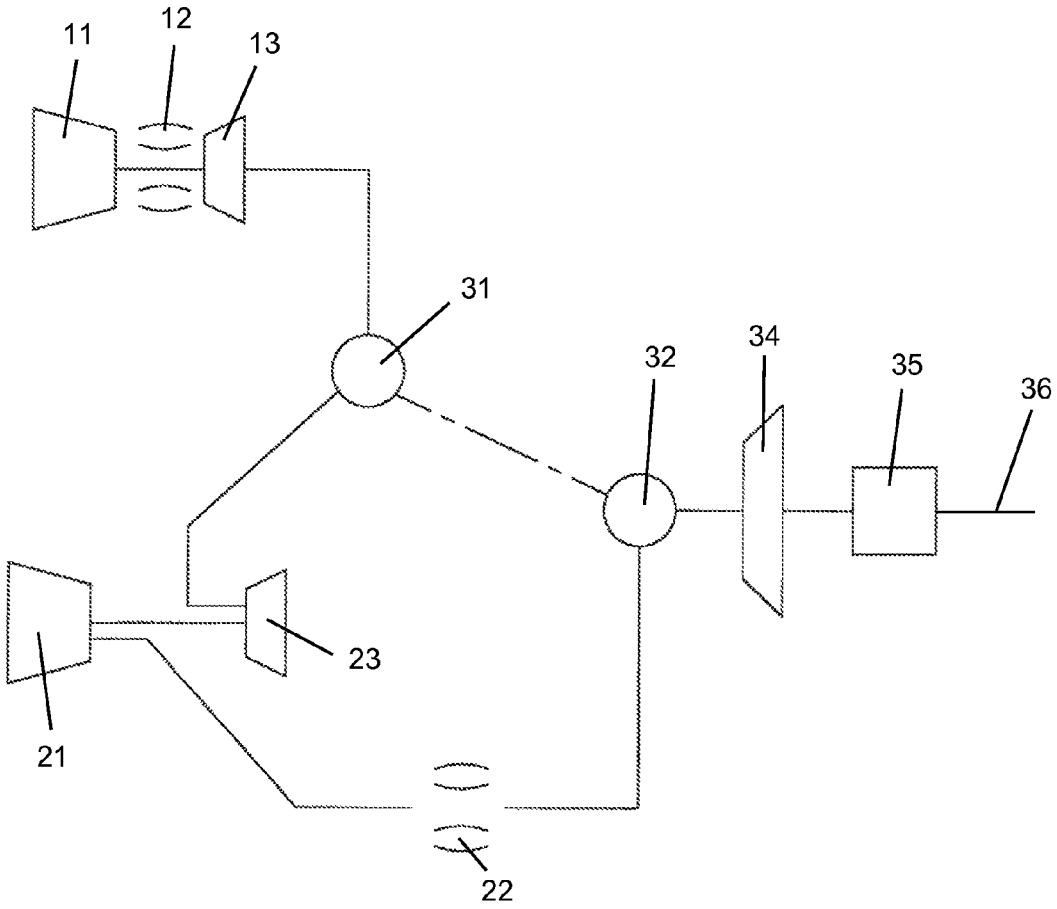
FIG. 3 shows high efficiency power plant of the present invention in a high power operational mode.

The high efficiency power plant of FIG. 1 can operate in its most efficient operation as seen in FIG. 2 or in a high power state such as take off or dash speed as seen in FIG. 3. In the loiter speed seen in FIG. 2, only the high pressure ratio engine is operated. The first compressor 11 produces a high pressure compressed air for the first combustor 12 that burns a fuel to produce a high pressure hot gas stream that is then passed through the first turbine 13 that then drives the first compressor 11. The hot exhaust from the first turbine 13 flows through the first flow valve 31, through the hot gas conduit 33 and into the second flow valve 32 and then into the power turbine 34. None of the turbine exhaust from the first turbine 13 flows into the second turbine 23 in the loiter speed mode of operation. Only the high pressure ratio engine (11,12,13) is used to drive the power turbine in the loiter operation. The power turbine 34 then drives the propeller or fan through the output shaft 36.

The high power operational mode of the hybrid engine is shown in FIG. 3. The turbine exhaust from the first turbine 13 flows through the first flow valve 31 and is directed by it to flow into the inlet of the second turbine 23. The hot exhaust gas from the first turbine 13 is used to power the second turbine 23 that then drives the second compressor 21 to produce relatively low pressure compressed air for the second combustor 22. The low pressure compressed air is burned with a fuel to produce a hot gas stream that then flows through the second flow valve 32 and into the power turbine 34 to drive the output shaft 36. The high power core (second engine) delivers compressed air that is heated (by the second combustor 22) prior to entering the power turbine 34. Because both engines burn a fuel, the same fuel can be used for both engines.

I claim the following:

1. A power plant for a UAV comprising:

a first gas turbine engine having a first compressor and a first combustor and a first turbine where the first turbine is connected to the first compressor by a first common rotor shaft;

a second gas turbine engine having a second compressor and a second turbine connected to the second compressor by a second common rotor shaft;

the second gas turbine engine having a second combustor that is not directed to discharge a hot gas stream into the second turbine;

a first flow valve connected to the first turbine and directed to selectively channel a first turbine hot exhaust into an inlet of the second turbine or into a second flow valve in flow series with the first valve;

the second compressor is connected to the second combustor such that compressed air from the second compressor flows into the second combustor;

the second combustor is connected to the second flow valve such that a hot gas stream produced in the second combustor flows into the second flow valve;

a hot gas conduit connected between the first flow valve and the second flow valve;

a power turbine connected to the second flow valve such that a hot gas flow from the second flow valve will flow into the power turbine;

an output shaft driven by the power turbine to propel the UAV;

in a power mode, both the first gas turbine engine and the second gas turbine engine are operated in which the first turbine hot exhaust flows from the first flow valve and into the second turbine, and a second hot gas from the second combustor flows into the second flow valve and into the power turbine; and, in a loiter mode, the second gas turbine engine is not operated while the first gas turbine engine produces the first hot gas flow that flows through the first flow valve and the second flow valve and into the power turbine.

2. The power plant of claim 1, and further comprising:

the first gas turbine engine is operated at both a low power mode and a high power mode; and, the second gas turbine engine is not operated at the low power mode.

3. The power plant of claim 1, and further comprising:

the first gas turbine engine is a relatively high pressure ratio engine; and, the second gas turbine engine is a relatively low pressure ratio engine.

4. A power plant for a UAV comprising:

a first gas turbine engine to produce a first hot gas flow;

a second gas turbine engine to produce a second hot gas flow;

a power turbine connected to drive a propeller shaft of the UAV;

a first flow valve connected to receive the first hot gas flow from the first gas turbine engine;

the first flow valve connected to a second flow valve in flow series with the first flow valve and the second gas turbine engine to deliver the first hot gas flow to either the second turbine of the second gas turbine engine or the second flow valve; the second flow valve connected to the power turbine, which receives hot gas flow from the second flow valve;

the second gas turbine engine having a second compressor and a second combustor with an inlet connected to the second compressor and an outlet connected to the second flow valve and not the second turbine;

in a power mode, both the first gas turbine engine and the second gas turbine engine are operated in which the first hot gas flow flows from the first flow valve and into the second turbine, and the second hot gas flow flows into the second flow valve and into the power turbine; and, in a loiter mode, the second gas turbine engine is not operated while the first gas turbine engine produces the first hot gas flow that flows through the first flow valve and the second flow valve and into the power turbine.

5. The power plant of claim 4, and further comprising:

the first gas turbine engine is operated at both a low power mode and a high power mode; and, the second gas turbine engine is not operated at the low power mode.

6. The power plant of claim 4, and further comprising:

the first gas turbine engine is a relatively high pressure ratio engine; and, the second gas turbine engine is a relatively low pressure ratio engine.

* * * * *